US005904602A

United States Patent [19]

Rumler et al.

[11] Patent Number: 5,904,602

[45] Date of Patent: May 18, 1999

[54] AUXILIARY MOTOR DIRECTIONAL CONTROL SYSTEM

[76] Inventors: Anthony J. Rumler, 17118 Rabbit Run Dr., Strongsville, Ohio 44136; Fritz R. Niederhauser, 32 Oak St., Sheffield Lake, Ohio 44054

[21] Appl. No.: 08/850,336

[22] Filed: May 2, 1997

Related U.S. Application Data

[60] Provisional application No. 60/016,921, May 6, 1996.

[51] Int. Cl.[6] ..... B63H 20/12

[52] U.S. Cl. ..... 440/61; 114/150

[58] Field of Search ..... 440/61, 62, 63, 440/57; 114/150, 164

[56] References Cited

U.S. PATENT DOCUMENTS

| | | | |
|---|---|---|---|
| 2,829,616 | 4/1958 | O'Brien et al. | 114/150 |
| 2,936,730 | 5/1960 | Patty, Jr. | 440/61 |
| 3,498,060 | 3/1970 | Smith | 114/150 |
| 4,431,422 | 2/1984 | Hall | 440/61 |
| 4,836,812 | 6/1989 | Griffiths | 440/63 |
| 5,466,178 | 11/1995 | Inman, Sr. | 440/61 |
| 5,549,493 | 8/1996 | Bezzi | 440/57 |

*Primary Examiner*—Sherman Basinger

*Attorney, Agent, or Firm*—Pearne, Gordon, McCoy & Granger LLP

[57] ABSTRACT

A steering system for directional control of an auxiliary engine using an existing helm steering system for the directional control of a primary engine. The steering system includes a master hydraulic cylinder having a rod connected to the primary engine, a slave hydraulic cylinder having a rod connected to the auxiliary engine, and hydraulic-fluid lines connecting the slave cylinder to the master cylinder to provide fluid flow communication therebetween. Movement of the master cylinder rod causes hydraulic fluid to flow from the master cylinder to the slave cylinder which moves the slave cylinder rod so that the auxiliary engine is controlled the same as the primary engine. The steering system can be used with inboard powered boats, inboard/outboard powered boats, outboard powered boats, and sailboats, each of which have an auxiliary engine.

9 Claims, 3 Drawing Sheets

AUXILIARY MOTOR DIRECTIONAL CONTROL SYSTEM

This application claims the benifit of U.S. Provisional Application No. 60/016,921 filed May 6, 1996.

BACKGROUND OF THE INVENTION

The present invention generally relates to a steering system for a marine vessel and, more specifically, to a steering system for controlling an auxiliary engine through a helm steering system for controlling a primary engine.

Inboard, inboard/outboard, and outboard powered boats are generally equipped with a relatively large engine for powering the boat under normal circumstances. A steering system which controls the direction of movement of the boats typically includes a steering wheel located at a helm. These large engines, however, are not practical for slow travel, as is necessary when trolling, docking, or other slow speed operations. It is very common for such boats to be equipped with a second or auxiliary outboard engine or motor which is relatively smaller than the large engine. The auxiliary motor is typically mounted on the main transom of the boat or, in the alternative, on an auxiliary transom that is carried on the main transom. Often the auxiliary motor is mounted at a location lower than the main transom, which makes it very difficult to use the conventional steering system which controls the large engine for manual steering of the auxiliary engine.

The inventors, as owners and operators of such boats, recognized that there is a need in the field for a steering system which is capable of controlling the direction of movement of the auxiliary motor in response to the rotation of the helm steering wheel. The inventors also recognized such a need for sailboats having an auxiliary motor.

Therefore, it is an object of the present invention to provide a simple and safe means for the directional control of an auxiliary motor using an existing helm steering system for the directional control of the main or primary engine. It is another object of the present invention to provide such directional control of the auxiliary motor when the existing helm steering system is either a cable-type system or a hydraulic-type system.

BRIEF SUMMARY OF THE INVENTION

The present invention provides a steering system for a marine vessel having a primary propulsion device and an auxiliary propulsion device which overcomes at least some of the above-noted problems of the related art. According to the present invention, the steering system includes a master cylinder having a cylinder rod operatively connected to the main propulsion device, a slave cylinder having a cylinder rod operatively connected to the auxiliary propulsion device, and hoses connecting the slave cylinder to the master cylinder to provide fluid flow communication therebetween. Movement of the cylinder rod of the master cylinder rod causes fluid flow from the master cylinder to the slave cylinder to move the cylinder rod of the slave cylinder so that the auxiliary propulsion device moves in the same direction as the primary propulsion device.

This steering system provides a means for the directional control of the auxiliary engine using an existing helm steering system for the directional control of the primary engine. The steering system provides a highly accurate trolling system which can be used with many types of powered vessels. For example, the steering system can be used with inboard powered boats (having push-pull cable steering for the primary engine), inboard powered boats (having hydraulic steering for the primary engine), inboard/outboard powered boats, outboard powered boats (having hydraulic steering for the primary engine), outboard powered boats (having push-pull cable steering for the primary engine), and sailboats, each of which have an auxiliary engine.

BRIEF DESCRIPTION OF THE SEVERAL VIEWS OF THE DRAWINGS

These and further features of the present invention will be apparent with reference to the following description and drawings, wherein.

DETAILED DESCRIPTION OF PREFERRED EMBODIMENTS

Figure 1:
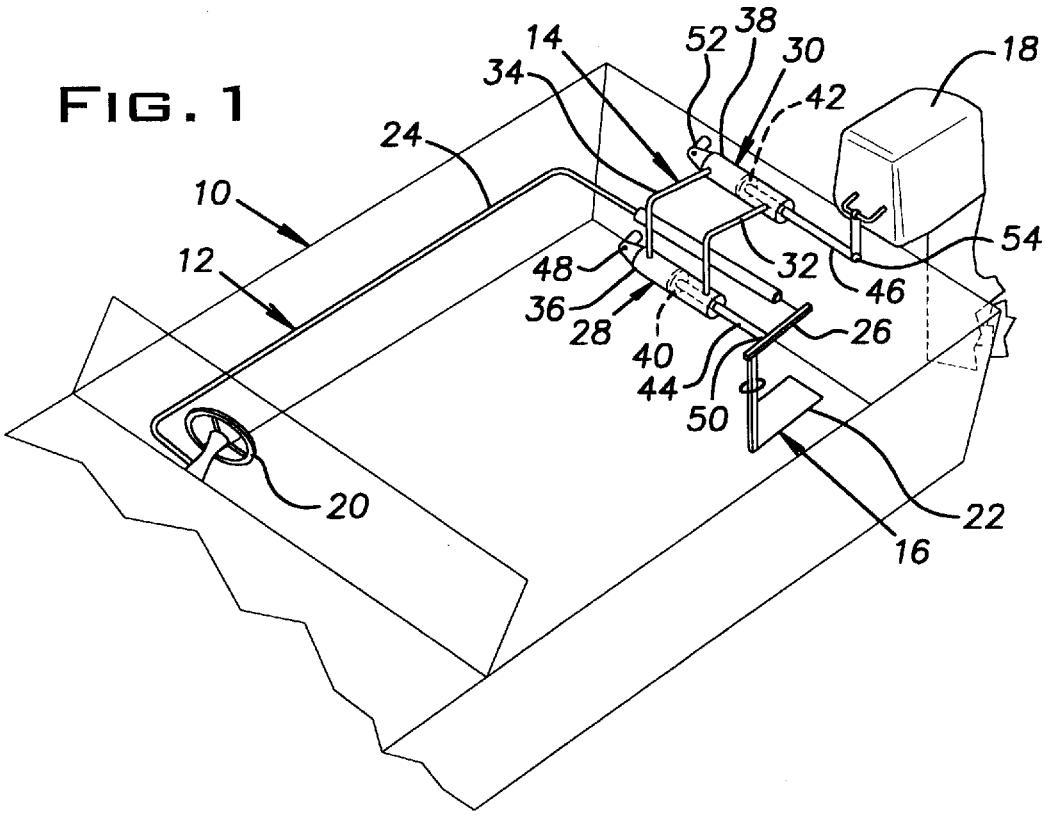
FIG. 1 is a diagrammatic view of an inboard powered boat according to a first embodiment of the present invention.

FIG. 1 illustrates an inboard powered marine vessel or boat 10 according to a first embodiment of the present invention. The boat 10 has a steering system which includes a primary directional control system 12, which is a mechanical or cable system, and an auxiliary directional control system 14, which is a hydraulic system. The primary directional control system 12 is used to steer the boat 10 when a primary or main propulsion unit of the boat 10 is operating. The primary propulsion unit of the illustrated boat 10 is an inboard motor or engine 16. The auxiliary directional control system 14 is used to steer the boat 10 when a secondary or auxiliary propulsion unit of the boat 10 is operating. The auxiliary propulsion unit of the illustrated boat 10 is an outboard motor or engine 18 pivotally mounted to the rear of the boat 10.

The primary directional control system 12 includes a steering wheel 20, a pivotable rudder located at a rear end of the boat 10, and a Bowden-type or "push-pull" cable assembly 24. The cable assembly 24 connects the steering wheel 220 with an arm 26 of the rudder 22 so that rotational motion of the steering wheel 20 is translated into pivotal motion of the rudder 22. The arm 26 extends rearwardly from the generally vertical pivot axis of the rudder 22. When the boat 10 is powered by the primary engine 16, the operator can steer the boat 10 by turning the steering wheel 20 which pivots the rudder 22.

The auxiliary directional control system 14 includes a first or master cylinder 28, a second or slave cylinder 30, and pair of conduits or hoses 32, 34. Each of the cylinders 28, 30 are preferably conventional fluid cylinders having a cylinder or body 36, 38 forming a sealed interior space, a piston 40, 42 which reciprocally moves within the interior space and a rod 44, 46 attached to the piston 40, 42 which extends or retracts from the body 36, 38 to vary the length of the cylinder 28, 30.

The master cylinder 28 is located at the rear of the boat 10 near the rudder 22. The piston end or body 36 of the master cylinder 28 is connected to a pivot-type mounting support or bracket 48 which is fixed to the boat 10. The rod end or rod 44 of the master cylinder 28 is attached to the rudder arm 26 by means of a connecting link 50 so that movement of the rudder 22 retracts or extends the rod 44 and moves the piston 40 within the body 36.

The slave cylinder 30 is mounted to the transom of the boat 10 in the proximity of the auxiliary engine 18. The piston end or body 38 of the slave cylinder 30 is mounted to the transom by means of a swivel-type joint 52. The rod end or rod 46 of the slave cylinder 30 is attached to the auxiliary engine 18 by means of a connecting link or bracket 54 so that movement of the slave cylinder piston 40 retracts or extends the slave cylinder rod 46 and pivots the auxiliary engine 18. The slave cylinder rod 46 is connected to the auxiliary engine 18 forward of the generally vertical pivot or steering axis of the auxiliary engine 18.

The hoses 32, 34 connect the master and slave cylinders 28, 30 for fluid flow therebetween in a parallel configuration. The first hose 32 connects a first end of the master cylinder body 36 with a first end of the slave cylinder body 38 and the second hose 34 connects a second end of the master cylinder body 36 with a second end of the slave cylinder body 38. The master cylinder 28, the slave cylinder 30, and the connecting hoses 32, 34 are all filled with a fluid such as a hydraulic fluid. The system pressure can be manually increased to higher operating levels if required. Connected in this manner, the slave cylinder rod 46 retracts when the master cylinder rod 44 extends and extends when the master cylinder rod 44 retracts. The slave cylinder 30 is oriented in the same direction as the master cylinder 28 so that the movement of the master cylinder 28, which is reflected in an opposite movement (extension or retraction) of the slave cylinder 30, orients the auxiliary engine 18 in the same direction as the rudder 22.

During operation, rotation of the steering wheel 20 causes rotation of the rudder 22 through the cable assembly 24 and the rudder arm 26. The rudder arm 26, which moves in response to the turning of the steering wheel 20, also extends or retracts the master cylinder rod 44. The extension or retraction of the master cylinder rod 44 causes fluid to flow from the master cylinder 28 to the slave cylinder 30, resulting in movement of the slave cylinder rod 46 in a direction opposite to the movement of the master cylinder rod 44. It is this extension or retraction of the slave cylinder rod 46 which pivots the auxiliary engine 18 to match the movement of the rudder 22. When the boat 10 is powered by the auxiliary engine 18, the operator can steer the boat 10 by turning the steering wheel 20 which pivots or turns the auxiliary engine 18. Therefore, the operator can steer the boat 10 by turning the steering wheel 20 when the boat 10 is powered by either the primary engine 16 or the auxiliary engine 18.

Figure 2:
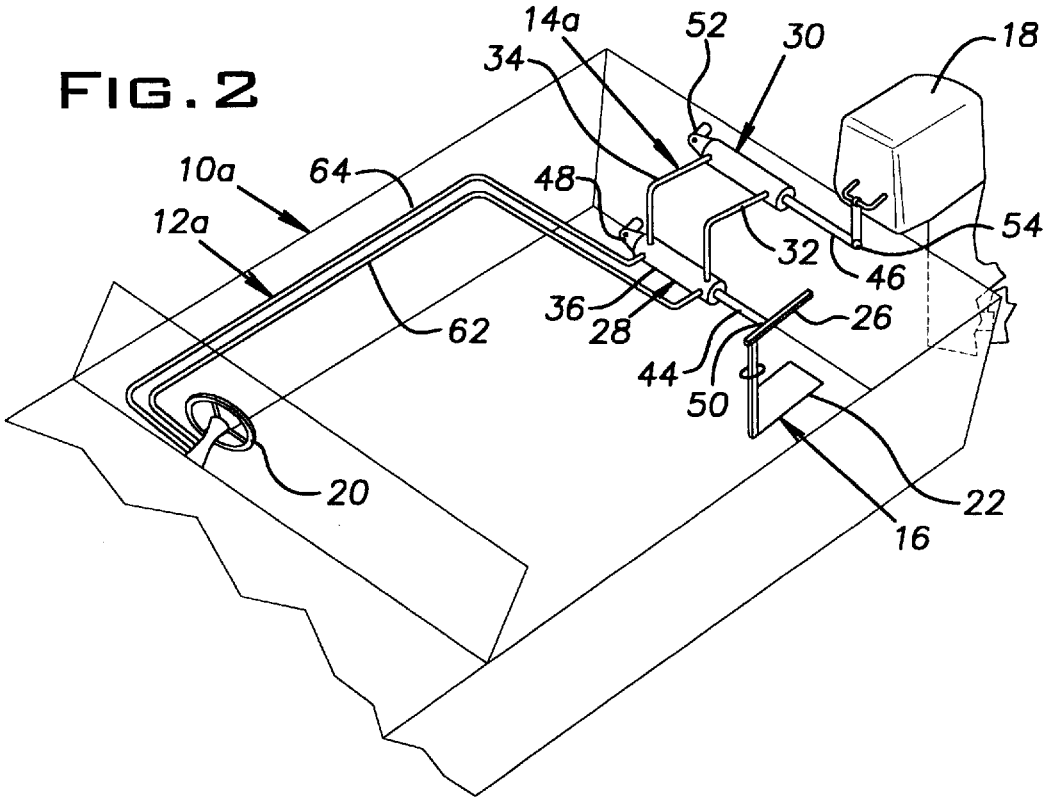
FIG. 2 is a diagrammatic view of an inboard powered boat according to a second embodiment of the present invention.

FIG. 2 illustrates an inboard powered boat 10*a* according to a second embodiment of the present invention wherein like reference numbers are used to illustrate like structure. The second embodiment is the same as the first embodiment except that a primary directional control system 12*a* is a hydraulic steering system instead of the previously described mechanical or cable system.

The hydraulic primary directional control system 12*a* includes the steering wheel 20, the pivotable rudder 22, the master cylinder 28, and a second pair of hoses or conduits 62, 64. The second pair of hoses 62, 64 connects the steering wheel 20 with opposite ends of the master cylinder body 36 so that rotational motion of the steering wheel 20 is translated into linear motion of the master cylinder rod 44 to pivot the rudder 22. When the boat 10 is powered by the primary engine 16, the operator can steer the boat 10 by turning the steering wheel 20 which pivots the rudder 22.

The auxiliary directional control system 14*a* includes the slave cylinder 30 and the first set of hoses 32, 34. The slave cylinder 30 is attached and operates as described above and the first pair of hoses 32, 34 connect the master cylinder 28 and slave cylinder 30 in a parallel configuration as described above.

During operation, rotation of the steering wheel 20 causes rotation of the rudder 22 through the second pair of hoses 62, 64 and the master cylinder 28. The master cylinder rod 44 moves by extending or retracting, in response to the turning of the steering wheel 20, to move the rudder arm 26 and pivot the rudder 22. The extension or retraction of the master cylinder 28 causes fluid to flow from the master cylinder 28 to the slave cylinder 30 through the first set of hoses 32, 34, resulting in extension or retraction of the slave cylinder rod 46. It is this extension or retraction of the slave cylinder rod 46 which pivots the auxiliary engine 18. When the boat 10*a* is powered by the auxiliary engine 18, the operator can steer the boat 10*a* by turning the steering wheel 20 which pivots or turns the auxiliary engine 18. Therefore, the operator can steer the boat 10*a* by turning the steering wheel 20 when the boat 10*a* is powered by either the primary engine 16 or the auxiliary engine 18.

Figure 3:
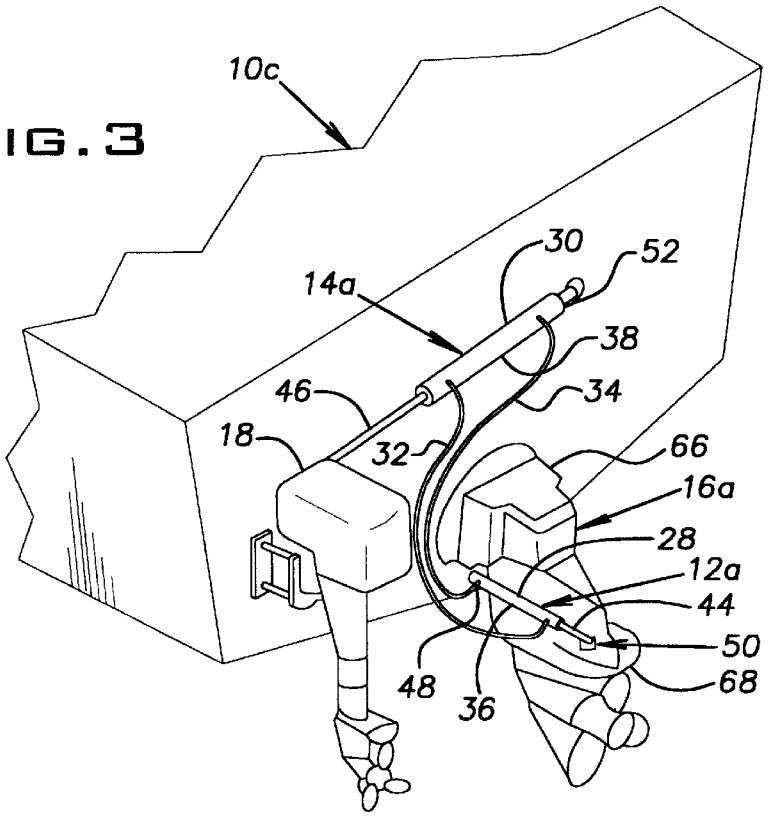
FIG. 3 is a diagrammatic view of an inboard/outboard powered boat according to a third embodiment of the present invention.

FIG. 3 illustrates an inboard/outboard powered boat 10*c* according to a third embodiment of the invention wherein like reference numbers are used to illustrate like structure. The third embodiment is the same as the second embodiment except that the primary engine 16*a* is an inboard/outboard engine rather than the previously described inboard engine.

The piston end or body, 36 of the master cylinder 28 is mounted to a stationary portion 66 of the primary engine 16*a* by means of the swivel-type joint 48. The rod end or rod 44 of the master cylinder 28 is attached to a pivoting portion 68, which includes a propeller, of the primary engine 16*a* by the connecting link 50 so that movement of the master cylinder piston 40 retracts or extends the master cylinder rod 44 and pivots or turns the pivoting portion 68 of the primary engine 16*a*. The master cylinder rod 44 is connected to the primary engine 16*a* rearward of the generally vertical pivot or steering axis of the primary engine 16*a*. When the boat 10*c* is powered by the primary engine 16*a*, the operator can steer the boat 10*c* by turning the steering wheel 20 (FIGS. 1 and 2) which pivots the pivoting portion 68 of the primary engine 16*a*.

The body end or body 38 of the slave cylinder 30 is mounted on the transom of the boat 10*c* by means of a flexible joint 52 adjacent the auxiliary engine 18. The rod end or rod 46 of the cylinder is attached to the connecting bracket 54 (FIGS. 1 and 2) affixed to the auxiliary engine 18. The slave cylinder rod 46 is connected to the auxiliary engine 18 forward of the generally vertical pivot or steering axis of the auxiliary engine 18. The slave cylinder 30 is oriented so that the movement of the master cylinder 28, which is reflected in the same movement (extension or retraction) of the slave cylinder 28, orients the auxiliary engine 18 in the same direction as the pivoting portion 68 of the primary engine 16*a*.

During operation, rotation of the steering wheel 20 (FIGS. 1 and 2) causes rotation of the primary engine pivoting portion 68 through the second pair of hoses 62, 64 (FIG. 2) and the master cylinder 28. The master cylinder rod 44 extends or retracts, in response to the turning of the steering wheel 20, to pivot the primary engine pivoting portion 68. The extension or retraction of the master cylinder 28 also causes fluid to flow from the master cylinder 28 to the slave cylinder 30 through the first set of hoses 32, 34, resulting in the same movement of the slave cylinder rod 46. It is this same extension or retraction of the slave cylinder rod 46 which pivots the auxiliary engine 18 in the same direction as the pivoting portion 68 of the primary engine 16*a*. When the boat 10*c* is powered by the auxiliary engine 18, the operator can steer the boat 10*c* by turning the steering wheel 20 which pivots or turns the auxiliary engine 18. Therefore, the operator can steer the boat 10*c* by turning the steering wheel 20 when the boat 10*c* is powered by either the primary engine 16*a* or the auxiliary engine 18.

Figure 4:
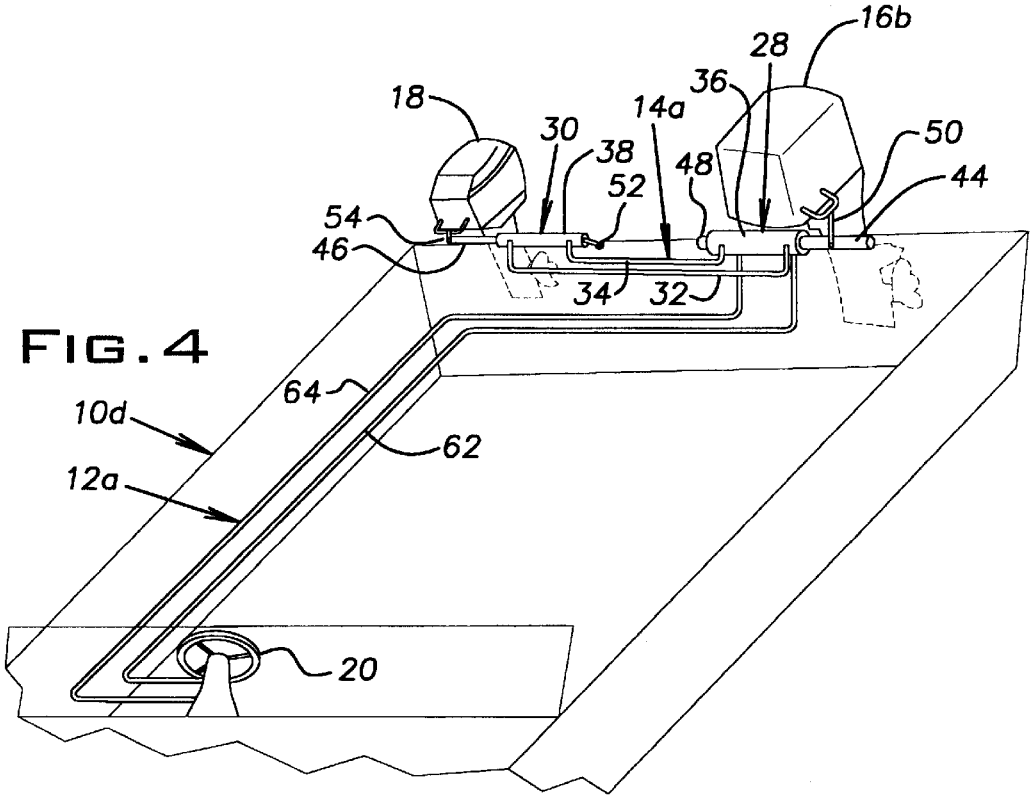
FIG. 4 is a diagrammatic view of an outboard powered boat according to a fourth embodiment of the present invention.

FIG. 4 illustrates an outboard powered boat 10*d* according to a fourth embodiment of the present invention wherein like reference numbers are used to illustrate like structure. The fourth embodiment is the same as the third embodiment except that the primary engine 16*b* is an outboard engine rather than the previously described inboard and inboard/outboard engines.

The piston end or body 36 of the master cylinder 28 is mounted to the transom of the boat 10*d* by means of the swivel-type bracket 48 adjacent the primary engine 16*b*. The rod end or rod 46 of the master cylinder 28 is attached to the primary engine 16*b* by the connecting link 50 so that movement of the master cylinder piston 40 retracts or extends the master cylinder rod 46 and pivots or turns the primary engine 16*b*. The master cylinder rod 44 is connected to the primary engine 16*b* forward of the generally vertical pivot or steering axis of the primary engine 16*b*. When the boat 10*d* is powered by the primary engine 16*b*, the operator can steer the boat 10*d* by turning the steering wheel 20 which pivots the primary engine 16*b*.

The body end or body 38 of the slave cylinder 30 is mounted on the transom of the boat 10*d* by means of the flexible joint 52 adjacent the auxiliary engine 18. The rod end or rod 46 of the slave cylinder 30 is attached to the bracket 54 affixed to the auxiliary engine 18. The slave cylinder rod 46 is connected to the auxiliary engine 18 forward of the generally vertical pivot or steering axis of the auxiliary engine 18. The slave cylinder 30 is oriented in the direction opposite of the direction of the master cylinder 28 so that the movement of the master cylinder 28 to pivot the primary engine 16*b*, which is reflected in an opposite movement (extension or retraction) of the slave cylinder 30, orients the auxiliary engine 18 in the same direction as the primary engine 16*b*.

During operation, rotation of the steering wheel 20 causes rotation of the primary engine 16*b* through the second pair of hoses 62, 64 and the master cylinder 28. The master cylinder rod 44 extends or retracts, in response to the turning of the steering wheel 20, to pivot the primary engine 16*b*. The extension or retraction of the master cylinder 28 also causes fluid to flow from the master cylinder 28 to the slave cylinder 30, resulting in an opposite movement of the slave cylinder rod 46. It is this opposite extension or retraction of the slave cylinder rod 46 which pivots the auxiliary engine 18 in the same direction as the primary engine 16*b*. When the boat 10*d* is powered by the auxiliary engine 18, the operator can steer the boat 10*d* by turning the steering wheel 20 which pivots or turns the auxiliary engine 18. Therefore, the operator can steer the boat 10*d* by turning the steering wheel 20 when the boat 10*d* is powered by either the primary engine 16*b* or the auxiliary engine 18.

Figure 5:
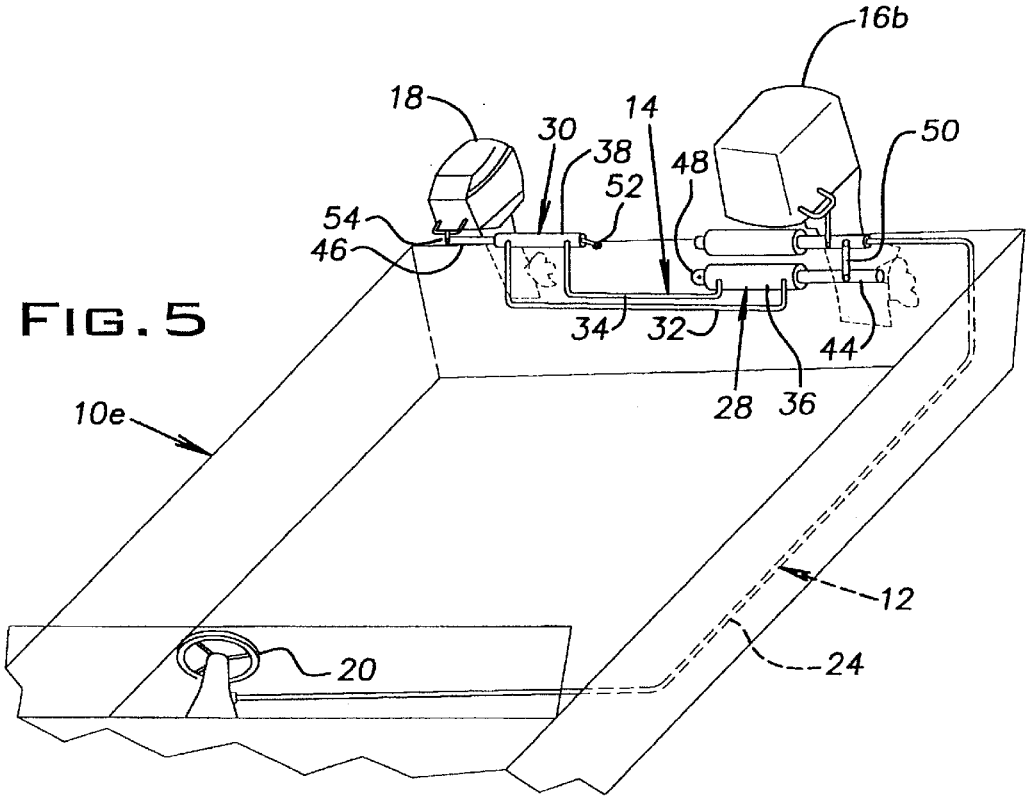
FIG. 5 is a diagrammatic view of an outboard powered boat according to a fifth embodiment of the present invention.

FIG. 5 illustrates an outboard powered boat 10 *e* according to a fifth embodiment of the present invention wherein like reference numbers are used to illustrate like structure. The fifth embodiment is the same as the fourth embodiment except that the primary directional control system 12 is a mechanical system rather than the described hydraulic system.

The mechanical primary directional control system 12 is the same as described above with regard to the first embodiment of the present invention. The Bowden-type or "push-pull" cable assembly 24 connects the steering wheel 20 with the primary engine 16*b* so that rotational motion of the steering wheel 20 is translated into pivotal motion of the primary engine 16*b*. The cable assembly 24 is connected forward of the generally vertical pivot or steering axis of the primary engine 16*b*. When the boat 10*e* is powered by the primary engine 16*b*, the operator can steer the boat 10*e* by turning the steering wheel 20 which pivots the primary engine 16*b*.

The master cylinder 28 is attached in a parallel configuration with the cable assembly 24. The piston end or body 36 of the master cylinder 28 is mounted to the transom of the boat 10*e* adjacent the primary engine 16*b* by means of the swivel-type bracket 48. The rod end or rod 44 of the master cylinder 28 is attached to the cable assembly 24 by means of the connecting link 50 so that movement of the cable assembly 24 retracts or extends the master cylinder rod 44 and moves the master cylinder piston 40.

The piston end or body 38 of the slave cylinder 30 is mounted on the transom of the boat 10*e* adjacent the auxiliary engine 18 by means of the swivel-type joint 52. The rod end or rod 46 of the slave cylinder 30 is attached to the bracket 54 affixed to the auxiliary engine 18. The slave cylinder rod 46 is connected to the auxiliary engine 18 forward of the generally vertical pivot or steering axis of the auxiliary engine 18. The slave cylinder 30 is oriented so that movement of the master cylinder 28, which is reflected in an opposite movement of the slave cylinder 30, orients the auxiliary engine 18 in the same direction as the primary engine 16*b*.

During operation, rotation of the steering wheel 20 causes rotation of the primary engine 16*b* through the cable assembly 24. The movement of the cable assembly 24 also retracts or extends the master cylinder rod 44. The extension or retraction of the master cylinder rod 44 causes fluid to flow from the master cylinder 28 to the slave cylinder 30 through the first pair of hoses 32, 34, resulting in an opposite movement of the slave cylinder rod 46. It is this opposite extension or retraction of the slave cylinder rod 46 which pivots the auxiliary engine 18 in the same direction as the primary engine 16*b*. When the boat 10*e* is powered by the auxiliary engine 18, the operator can steer the boat 10*e* by turning the steering wheel 20 which pivots or turns the auxiliary engine 18. Therefore, the operator can steer the boat 10*e* by turning the steering wheel 20 when the boat 10*e* is powered by either the primary engine 16*b* or the auxiliary engine 18.

Figure 6:
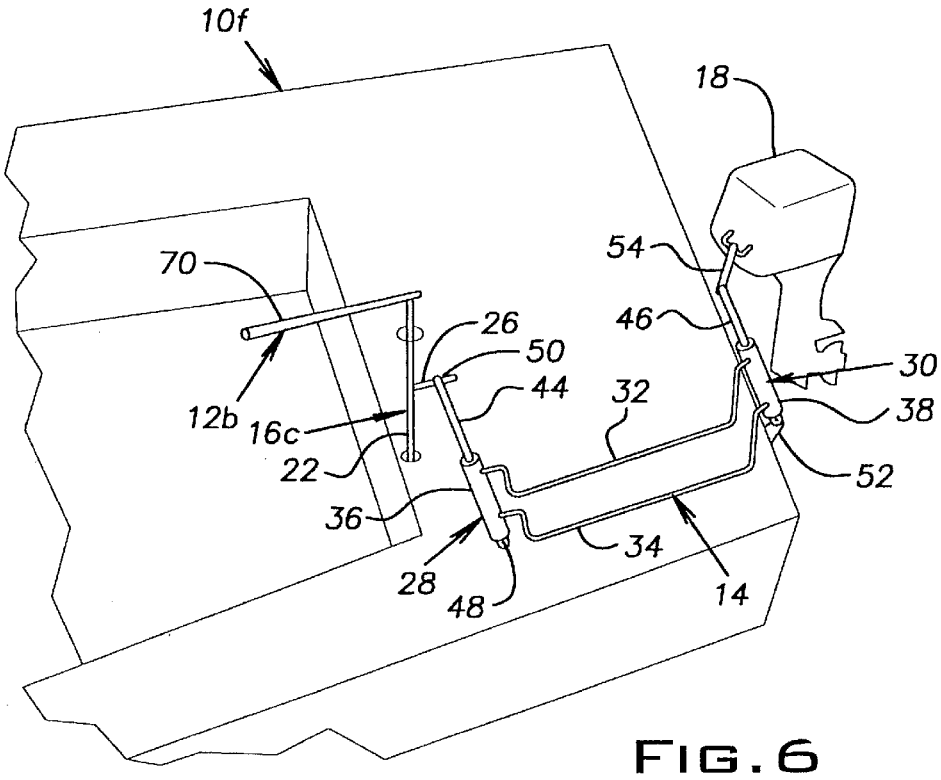
FIG. 6 is a diagrammatic view of a sail boat according to a sixth embodiment of the present invention.

FIG. 6 illustrates a sailboat 10*f* according to a sixth embodiment of the present invention wherein like reference numbers are used to illustrate like structure. The fifth embodiment is the same as the first embodiment except that the primary engine 16*c* is a sail system rather than the above described inboard engine and the primary directional control system 12*b* is a direct or local system instead of the above described remote or cable system.

The primary directional control system 12*b* includes a tiller 70 forwardly extending from the top of the rudder 22.

The operator can steer the boat 10*f* by turning the tiller 70 which directly pivots or rotates the rudder 22.

The piston end or body 36 of master cylinder 28 is fixed to the boat 10*f* adjacent the rudder 22 by means of the swivel-type bracket 48. The rod end or rod 44 of the master cylinder 28 is fixed to the rudder arm 26 which rearwardly extends form the rudder 22 by means of the connecting link 50. When the tiller 70 rotates the rudder 22 to steer the boat, the rudder arm 26 is also rotated. This rotation of the rudder arm 26 causes a movement (extension or retraction) of the master cylinder rod 28.

The slave cylinder 30 is fluidly connected with the master cylinder 28 in a parallel configuration as described above. The piston end or body 38 of the slave cylinder 30 is mounted on the transom of the boat 10*f* in the proximity of the auxiliary engine 18 by the swivel-type joint 52. The rod end or rod 46 of the slave cylinder 30 is attached to the bracket 54 fixed to the auxiliary engine 18. The slave cylinder 30 is oriented so that the movement of the master cylinder 28, which is reflected in an opposite movement of the slave cylinder 30, orients the auxiliary engine 18 in the same direction as the rudder 22.

During operation, turning the tiller 70 directly rotates the rudder 22. The rotation of the rudder 22 retracts or extends the master cylinder rod 44 through the rudder arm 26. The extension or retraction of the master cylinder 28 causes fluid to flow from the master cylinder 28 to the slave cylinder 30 through the first pair of hoses 32, 34, resulting in an opposite movement of the slave cylinder rod 46. It is this opposite extension or retraction of the slave cylinder rod 46 which pivots the auxiliary engine 18 in the same direction as the rudder 22. When the boat 10*f* is powered by the auxiliary engine 18, the operator can steer the boat 10*f* by turning the tiller 70 which pivots or turns the auxiliary engine 18. Therefore, the operator can steer the boat 10*f* by turning the tiller 70 when the boat is powered by either the primary engine 16*c* or the auxiliary engine 18.

It can be seen from the above description that the steering system of the present invention provides a very simple method to attach the auxiliary motor to an existing steering system for the primary engine and can be easily and quickly installed. The steering system can remain connected to the auxiliary motor, whether the auxiliary motor is in a raised or a lowered position. This means that once the steering system is attached to the auxiliary motor, there is no need to disconnect the steering system when it is not in use. In the unlikely event of a steering system failure, however, the steering system is easily detachable, thereby allowing steering of the boat to be accomplished manually.

Additionally, the steering system does not require any additional on-board power systems (i.e., electric or hydraulic) in order to operate and is totally isolated from other existing on-board systems (i.e., hydraulic or electric) in the boats having push-pull cable steering for the primary engine. The steering system operates at a very low system pressure (often less than 50 p.s.i. in boats having cable steering systems for the primary propulsion unit) which reduces wear and tear on the components of the steering system. The steering system also utilizes materials and components which provide long life and durability.

Furthermore, the boats can be steered from the helm at all times which allows the operator to steer the boats from the best vantage point, thereby increasing safety of operation. It should also be noted that the steering system uses no flammable fluids and operates at a low pressure.

Although particular embodiments of the invention have been described in detail, it will be understood that the invention is not limited correspondingly in scope, but includes all changes and modifications coming within the spirit and terms of the claims appended hereto.

What is claimed is:

1. A steering system for controlling a primary propulsion device and an auxiliary propulsion device of a marine vessel, said steering system comprising:

a master cylinder having a cylinder rod operatively connected to the main propulsion device;

a slave cylinder having a cylinder rod operatively connected to the auxiliary propulsion device; and hoses connecting said master cylinder to said slave cylinder to provide fluid flow communication therebetween, wherein movement of said cylinder rod of said master cylinder rod causes fluid flow from said master cylinder to said slave cylinder to move said cylinder rod of said slave cylinder so that the auxiliary propulsion device is oriented the same as the primary propulsion device.

2. The steering system according to claim 1, wherein said master cylinder and said slave cylinder are hydraulic cylinders.

3. The steering system according to claim 1, wherein said master cylinder and said slave cylinder are fluidly connected in a parallel configuration such that said cylinder rod of said slave cylinder and said cylinder rod of said master cylinder moves in an identical direction.

4. The steering system according to claim 1, further comprising a remote steering wheel and a cable assembly connecting said steering wheel to the primary propulsion unit.

5. A boat comprising:

a primary propulsion device;

an auxiliary propulsion device; and a steering system including:

a master cylinder having a cylinder rod operatively connected to said main propulsion device;

a slave cylinder having a cylinder rod operatively connected to said auxiliary propulsion device; and conduits connecting said master cylinder to said slave cylinder to provide fluid flow communication therebetween, wherein movement of said cylinder rod of said master cylinder rod causes fluid flow from said master cylinder to said slave cylinder to move said cylinder rod of said slave cylinder such that said auxiliary propulsion device moves with said primary propulsion device.

6. The boat according to claim 5, further comprising a remote steering wheel and additional conduits connecting said steering wheel with said master cylinder, wherein said primary propulsion unit is an inboard/outboard engine and said cylinder rod of said master cylinder is connected to a pivoting portion of said inboard outboard engine.

7. The boat according to claim 5, further comprising a remote steering wheel and a cable assembly connecting said steering wheel to said primary propulsion unit, wherein said primary propulsion unit is an outboard motor.

8. The boat according to claim 5, wherein said master cylinder and said slave cylinder are hydraulic cylinders.

9. The boat according to claim 5, wherein said master cylinder and said slave cylinder are fluidly connected in a parallel configuration such that said cylinder rod of said slave cylinder moves in an opposite direction than said cylinder rod of said master cylinder.

* * * * *